US006968623B2

(12) United States Patent
Braun et al.

(10) Patent No.: US 6,968,623 B2
(45) Date of Patent: Nov. 29, 2005

(54) HAIR TRIMMER WITH ADJUSTABLE COMB

(75) Inventors: Christopher J. Braun, Racine, WI (US); John M. Piwaron, Milwaukee, WI (US)

(73) Assignee: Andis Company, Sturtevant, WI (US)

( * ) Notice: Subject to any disclaimer, the term of this patent is extended or adjusted under 35 U.S.C. 154(b) by 81 days.

(21) Appl. No.: 10/464,203

(22) Filed: Jun. 18, 2003

(65) Prior Publication Data

US 2003/0233754 A1 Dec. 25, 2003

Related U.S. Application Data

(60) Provisional application No. 60/390,558, filed on Jun. 21, 2002.

(51) Int. Cl.[7] ..... B26B 19/20
(52) U.S. Cl. ..... 30/201; 30/233.5
(58) Field of Search ..... 30/196, 200, 201, 30/233, 233.5, 202, 43.1, 293

(56) References Cited

U.S. PATENT DOCUMENTS 3,222,781 A 12/1965 Luther et al.
3,648,370 A 3/1972 Cercone
3,992,778 A 11/1976 Urbush
4,557,050 A 12/1985 Haraguchi et al.
4,614,036 A 9/1986 Haraguchi
4,669,189 A * 6/1987 Ullmann ..... 30/201
4,776,095 A * 10/1988 Tsujimoto et al. ..... 30/201
4,845,852 A * 7/1989 Sukow ..... 30/201
4,949,460 A 8/1990 Sterk
5,084,974 A * 2/1992 Sukow et al. ..... 30/201
5,325,589 A 7/1994 Kubo
5,367,772 A 11/1994 Ogawa
5,604,985 A 2/1997 Andis et al.
5,898,999 A * 5/1999 Chaouachi et al. ..... 30/201
5,979,060 A * 11/1999 Holzbauer et al. ..... 30/201
6,079,103 A 6/2000 Melton et al.
6,125,545 A 10/2000 Yamaguchi et al.
6,578,269 B2 * 6/2003 Wilcox et al. ..... 30/201

* cited by examiner

*Primary Examiner*—Hwei-Siu Payer
(74) *Attorney, Agent, or Firm*—Michael Best & Friedrich LLP

(57) ABSTRACT

A hair trimmer having an adjustable comb actuator assembly capable of moving a comb to a number of positions between a fully retracted position and a fully extended position for varying the cutting length of the hair trimmer. The actuator assembly includes a comb carriage, a comb button, a lock spring, and a lock button.

17 Claims, 5 Drawing Sheets

HAIR TRIMMER WITH ADJUSTABLE COMB

CROSS-REFERENCE TO RELATED APPLICATIONS

This application claims priority from Provisional Application No. 60/390,558 filed Jun. 21, 2002 for "Hair Trimmer with Adjustable Comb" by John M. Piwaron.

FIELD OF THE INVENTION

The invention relates generally to hair trimmers and to adjustable combs, which are attachable to such hair trimmers to assist the operator in cutting hair to a particular length.

BACKGROUND OF THE INVENTION

It is desirable to utilize a hair trimmer to cut a person's or an animal's hair to a variety of lengths. To facilitate this, a hair trimmer is often provided with a set of combs. The combs include a variety of shapes and sizes that regulate the length of cut hair. Alternatively, a hair trimmer may include an adjustable comb that is movable between a variety of positions to cut hair to a variety of lengths, thus eliminating the need for several, separate combs.

Various linkage and coupling mechanisms have been used to facilitate positively locating the adjustable comb in various positions. An improved adjustable comb with a corresponding novel adjustment mechanism would be welcomed by those in the art.

SUMMARY OF THE INVENTION

The present invention provides a hair trimmer having an adjustable comb actuator assembly capable of moving a comb to a number of predetermined positions between a fully retracted position and a fully extended position for varying the cutting length of the hair trimmer. In particular, the actuator assembly includes a comb carriage, a comb button, a lock spring, and a lock button.

The removable comb slides over the body of the hair trimmer and engages the comb carriage through slots in the body of the hair trimmer. The comb carriage is carried primarily inside the body and is fixed to two tabs of the comb button that extend through parallel slots in the top portion of the body. The operator of the hair trimmer slidably moves the comb button along the outer surface of the top portion of the body to move the comb to the desired location. The lock button is slidably connected to the comb button and is biased toward an upper position by the lock spring.

The lock button includes a T-shaped protrusion that extends into the body and rides in an internal slot of the body. The internal slot has inwardly facing protrusions such that when the lock spring biases the lock button to the upper position, the T-shaped protrusion of the lock button rests between the inwardly facing protrusions, thus holding the comb in a fixed position. When the operator depresses the lock button, the T-shaped protrusion passes under the inwardly facing protrusions allowing the comb to be adjusted by slidably moving the comb button along the outer surface of the top portion of the body.

Additionally, the T-shaped protrusion of the lock button is designed with ramped portions that allow the T-shaped protrusion to ramp over the inwardly facing protrusions in the direction of the fully extended position. To move the comb button in the direction of the fully retracted position, the lock button must be depressed as discussed above.

When the comb is in the fully extended position, a minimum amount of hair is cut by the hair trimmer. When the comb is in the fully retracted position, a maximum amount of hair is cut by the hair trimmer. The plurality of inwardly facing protrusions of the internal slot facilitate the cutting of hair at a variety of predetermined lengths between the fully extended and retracted positions of the comb. A plurality of notch protrusions extending from the inside of the bottom portion of the body cooperate with the comb carriage to provide an indexing action between each predetermined position for ease of selection.

Further objects of the present invention, together with the organization and manner of operation thereof, will become apparent from the following detailed description of the invention when taken in conjunction with the accompanying drawings wherein like elements have like numerals throughout the drawings.

BRIEF DESCRIPTION OF THE DRAWINGS

The present invention is further described with reference to the accompanying drawings, which show an embodiment of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention. Also, it is understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," and "coupled" are used broadly and encompass both direct and indirect mountings, connections, and couplings. Further, "connected" and "coupled" are not restricted to physical or mechanical connections or couplings. Additionally, unless specified or limited otherwise, the terms "top," "bottom," "upper," "lower," "forward," "rearward," "outward," "inward," "sideward," "downward," and "upward" and variations thereof as used herein are not meant to indicate a particular direction, but rather a relative direction with respect to the context of the discussion.

DETAILED DESCRIPTION

Figure 2:
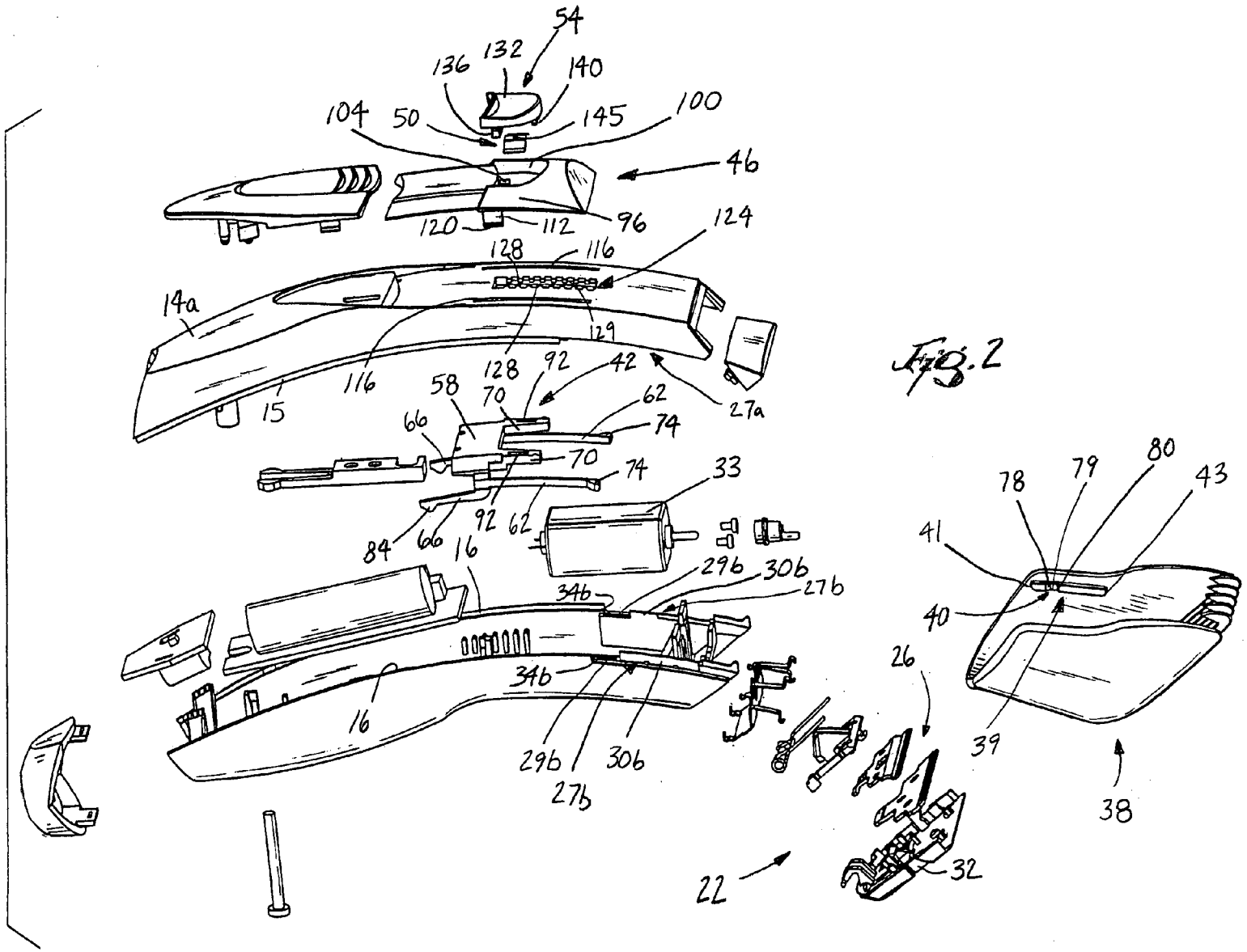
FIG. 2 is an exploded view of the hair trimmer shown in FIG. 1.
Figure 3:
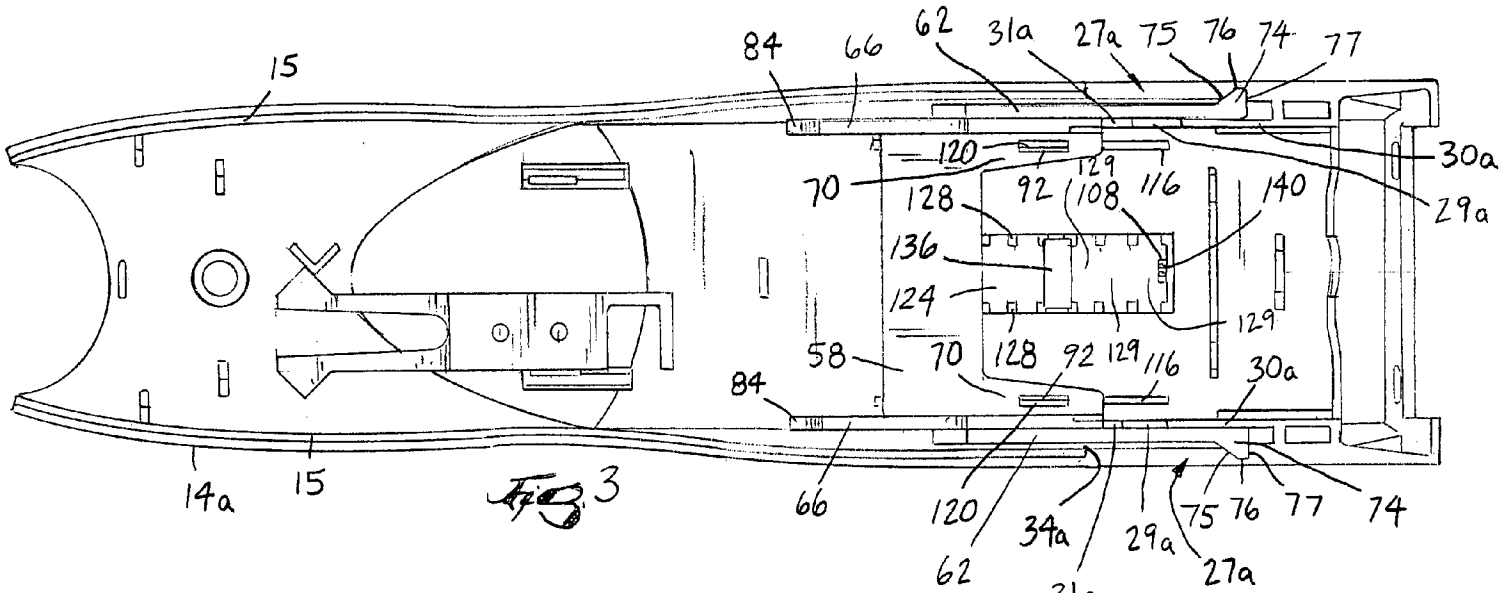
FIG. 3 is a bottom view of the top portion of the hair trimmer body shown in FIG. 1.
Figure 4:
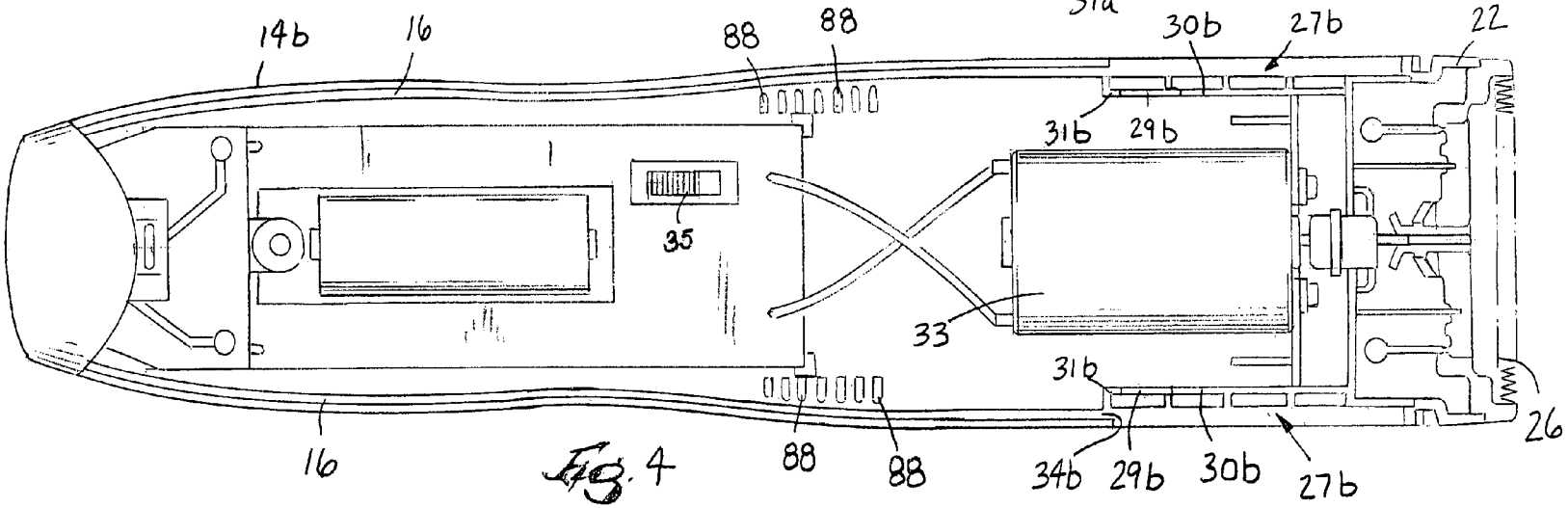
FIG. 4 is a top view of the bottom portion of the hair trimmer body shown in FIG. 1.
Figure 6:
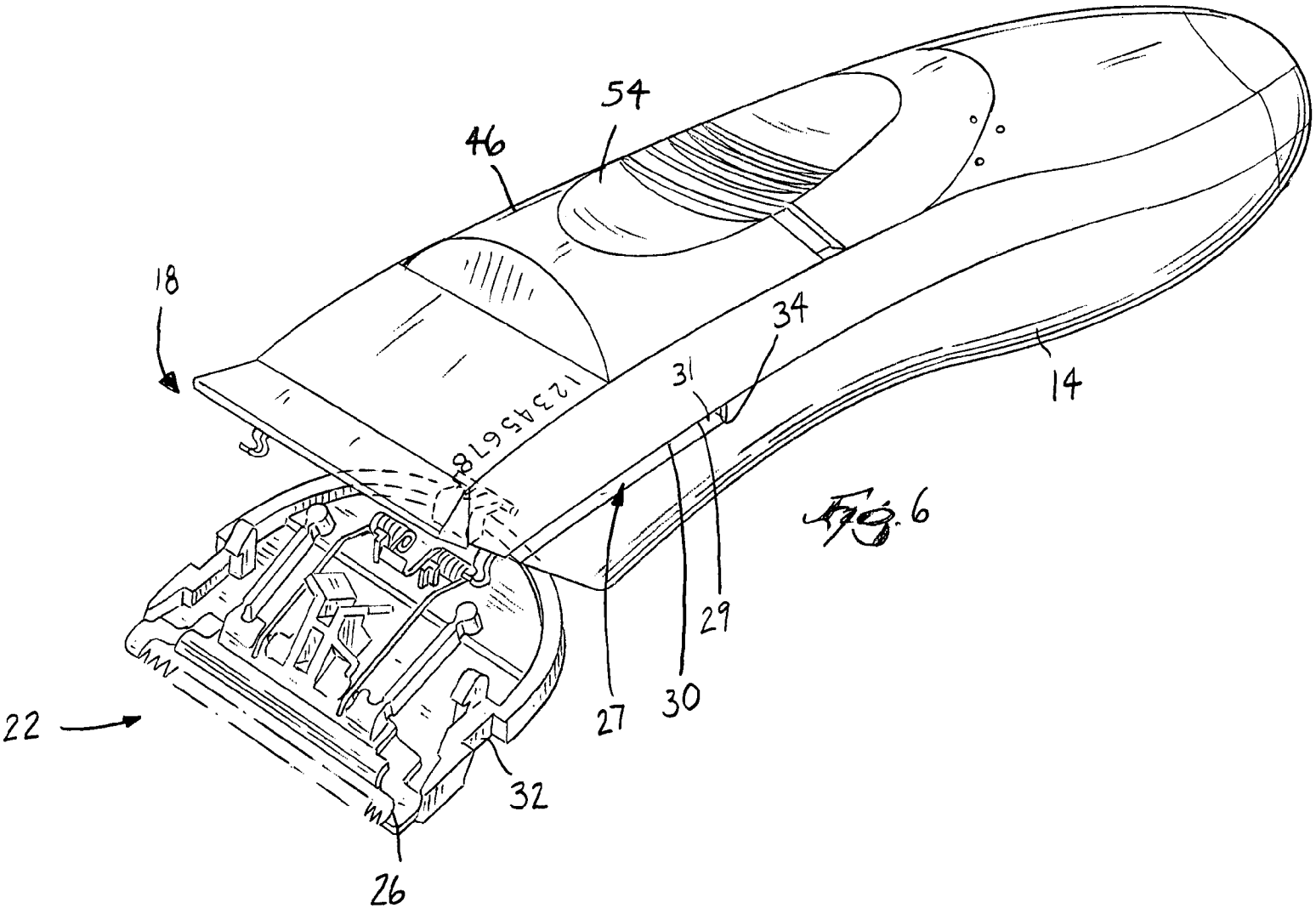
FIG. 6 is a view similar to FIG. 1 showing a cutting head of the hair trimmer in the open position.

The drawings illustrate a hair trimmer or clipper 10 including a hollow, elongated body 14 which, at a cutting end 18 (FIG. 1) thereof, supports a cutting head 22 (FIG. 6)

having a blade set 26 of any of various constructions. As best shown in FIGS. 2–4, the body 14 includes a top portion 14*a* and a bottom portion 14*b*. The top portion 14*a* includes tab members 15 and the bottom portion 14*b* includes notch members 16. The tab and notch members 15 and 16 cooperate to align the top and bottom portions 14*a* and 14*b* for assembly.

Referring to FIGS. 2, 3, 4, and 6, when the top and bottom portions 14*a* and 14*b* are assembled, a pair of slots 27 (FIG. 6) are formed on the cutting end 18 at the junction of the top and bottom portions 14*a* and 14*b*. Each slot 27 is formed by a top slot portion 27*a* of the top portion 14*a* and a bottom slot portion 27*b* of the bottom portion 14*b*. Each slot 27 includes a deflection aperture portion 29, formed by a top deflection aperture portion 29*a* of the top slot portion 27*a* and a bottom deflection aperture portion 29*b* of the bottom slot portion 27*b*, and a comb arm aperture portion 34, formed by a top comb arm aperture potion 34*a* of the top slot portion 27*a* and a bottom comb arm aperture portion 34*b* of the bottom slot portion 27*b*. The deflection and comb arm aperture portions 29 and 34 communicate with the interior of the body 14. Each slot also includes a first wall portion 30, formed of a top first wall portion 30*a* of the top slot portion 27*a* and a bottom first wall portion 30*b* of the bottom slot portion 27*b*, and a second wall portion 31, formed of a top second wall portion 31*a* of the top slot portion 27*a* and bottom second wall portion 31*b* of the bottom slot portion 27*b*. The first wall portion 30 flanks the cutting end side of the deflection aperture portion 29, and the second wall portion 31 is located between the deflection aperture portion 29 and the comb arm aperture portion 34. The cutting head 22 includes a pair of slots 32 (FIGS. 2 and 6) that align with the slots 27 when the cutting head 22 is in the operating position (FIG. 1).

Located in the body 14 is an electric motor 33 (FIGS. 2 and 4) which is drivingly connected to the blade set 26 to effect a cutting action in response to actuation of the motor 33. Any suitable motor and driving arrangement can be employed. The hair trimmer 10 includes an electric switch 35 (FIG. 4) that is connected to the motor 33 to control actuation thereof. Any suitable switch construction can be employed.

The hair trimmer 10 also includes a comb 38 (FIGS. 1 and 2) that surrounds a portion of the cutting end 18, and which is movable relative to the body 14 and the blade set 26 to control the length at which hair is cut. The comb 38 includes a pair of guides 39 that ride in the slots 27 and 32. Each guide 39 includes a notch 40, a first end 41, and a second end 43. The first and second ends 41 and 43 are ramped to facilitate movement within the slots 27 and 32.

Figure 1:
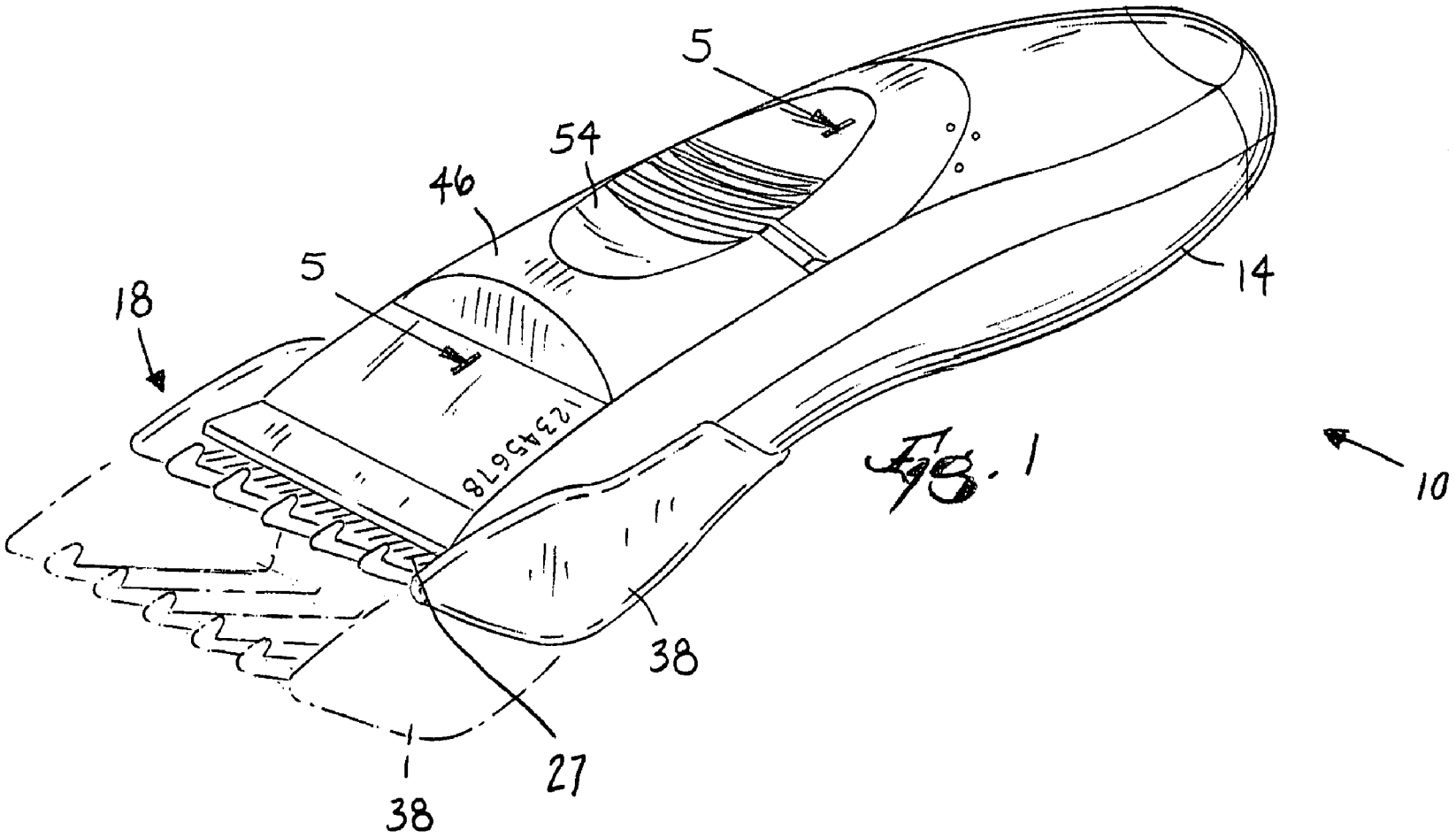
FIG. 1 is a perspective view of a hair trimmer embodying various features of the invention, including a body having a top portion and a bottom portion.

The comb 38 is shown in FIG. 1 in a fully extended position (dotted lines) and a fully retracted position (solid lines). When the comb 38 is in the fully extended position, a minimum amount of hair is cut by the hair trimmer 10. When the comb is in the fully retracted position, a maximum amount of hair is cut by the hair trimmer 10. Hair can also be cut at a number of other lengths when the comb 38 is positioned at predetermined positions between the fully extended and retracted positions.

The hair trimmer 10 includes an adjustable comb actuator assembly capable of moving the comb 38 between the fully retracted and extended positions for varying the cutting length of the hair trimmer 10. As shown in FIG. 2, the actuator assembly includes a comb carriage 42, a comb button 46, a lock spring 50, and a lock button 54.

The comb carriage 42 includes a main portion 58, a pair of comb arms 62, a pair of index arms 66, and a pair of comb button members 70. The comb arms 62 extend from the main portion 58 through the comb arm aperture portions 34 into the slots 27. For operation, the comb arms 62 are outwardly laterally supported by the tab members 15, inwardly laterally supported by the first and second wall portions 30 and 31, upwardly vertically supported by the top slot portion 27*a*, and downwardly vertically supported by the bottom slot portion 27*b* (directions defined with respect to FIG. 2).

As best seen in FIG. 3, each comb arm 62 includes a locking protrusion 74 having a ramped portion 75, an intermediate portion 76, and a flat portion 77. The shape of the locking protrusions 74 corresponds to the shape of the notches 40 (FIG. 2) which have a first ramped portion 78, an intermediate portion 79, and a second ramped portion 80. The locking protrusions 74 retain the comb 38 in the slots 27 and 32 for movement in response to actuation of the actuator assembly.

In the illustrated embodiment, the comb 38 is connected to the actuator assembly when the actuator assembly is in the fully retracted position. Attempts to connect the comb 38 to the actuator assembly in other positions may result in deformation of at least some components of the hair trimmer 10. The comb 38 connects to the actuator assembly by moving the guides 39 through the slots 27 and 32 until the locking protrusions 74 engage the notches 40. The guides 39 move freely in the slots 27 and 32 until the ramped portions of the first ends 41 contact the flat portions 77 of the locking protrusions 74. If the actuator assembly is in the fully retracted position, continued movement of the guides 39 in the slots 27 and 32 results in deflection of the locking protrusions 74 into the deflection aperture portions 29 of the slots 27. If the actuator assembly is not in the fully retracted position, the first and/or second wall portions 30 and 31 prevent the locking protrusions 74 from deflecting inwardly and the guides 39 are thereby prevented from continued movement in the slots 27 and 32.

Deflection of the locking protrusions 74 into the deflection aperture portions 29 allows the ramped portions of the first ends 41 to move over the flat portions 77 and onto the intermediate portions 76 of the locking protrusions 74. Continued movement of the guides 39 in the slots 27 and 32 results in interaction between the ramped portions 75 of the locking protrusions 74 and the ramped portions 78 of the notches 40. Such interaction allows the locking protrusions 74 to engage the notches 40. Once the portions 75, 76, and 77 of the locking protrusions 74 are adjacent to the corresponding portions 78, 79, 80 of the notches 40, the comb 38 is retained for movement in response to actuation of the actuator assembly.

Similarly, in the illustrated embodiment, the comb 38 is disconnected from the actuator assembly when the actuator assembly is in the fully retracted position. Attempts to disconnect the comb 38 from the actuator assembly in other positions may result in deformation of at least some components of the hair trimmer 10. The comb 38 is removed by performing the reverse of the process discussed above. As discussed further below, if the actuator assembly is not in the fully retracted position, force applied to the comb 38 in the direction of removal will likely result in an adjustment of the comb 38 in the direction of the fully extended position.

Figure 5:
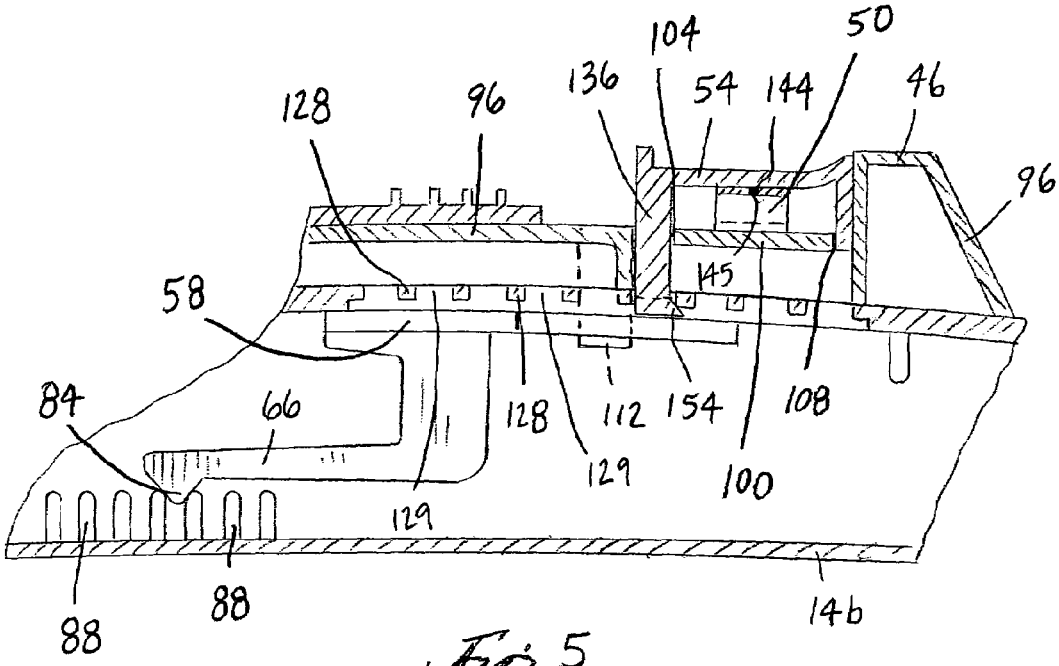
FIG. 5 is a fragmentary sectional view taken along 5—5 of FIG. 1.

The index arms 66 extend from the main portion 58 in a direction opposite the comb arms 62. The index arms 66 each include a ramped index protrusion 84 that cooperates with a set of upwardly facing or index protrusions 88 (FIGS. 4 and 5) extending from the bottom portion 14*b* of the body 14 to provide an indexing action to the movement of the actuator assembly. In the illustrated embodiment, each incremental indexing movement corresponds to a movement between consecutive predetermined positions for cutting hair. The set of upwardly facing protrusions 88 facilitate indexing movement between the fully retracted and extended positions. The comb button members 70 extend from the main portion 58 in a direction similar to the comb arms 62. Each comb button member 70 includes a comb button tab aperture 92.

The comb button 46 includes a main portion 96, a lock button recess 100 having a T-shaped protrusion aperture 104 (FIGS. 2 and 5) and a retainer clip aperture 108 (FIG. 5), and a pair of comb button tabs 112 extending downwardly from the main portion 96. The top portion 14*a* of the body 14 includes a pair of comb button slots 116. The comb button tabs 112 extend downwardly through the comb button slots 116 and into the comb button tab apertures 92 in the comb button members 70.

The comb button tabs 112 each include a locking member 120 having a ramped portion and a flat portion. The comb button tabs 112 are biased outwardly such that the ramped portions of the locking members 120 cause movement against the biasing forces as the locking members 120 move past the edges of the comb button tab apertures 92. Once the locking members 120 extend through the comb button tab apertures 92, the comb button tabs 112 are allowed to move outwardly, thereby locking the comb button tabs 112 in the comb button tab apertures 92. The flat portions of the locking members 120 prevent the comb button tabs 112 from releasing from the comb button tab apertures 92 without the introduction of an inwardly directed force to align the locking members 120 with the middle of the comb button tab apertures 92. When the comb button tabs 112 are locked in the comb button tab apertures 92, actuation of the comb button 46 results in corresponding movement of the comb carrier 42 and thus the comb 38 if the comb 38 is retained for such movement. During operation, the operator of the hair trimmer 10 slidably moves the comb button 46 along the outer surface of the top portion 14*a* of the body 14 to move the comb 38 to the desired location.

The top portion 14*a* of the body 14 also includes a lock button slot 124 having a plurality of inwardly facing protrusions 128. The inwardly facing protrusions define a plurality of cutting notches 129 (FIG. 4).

The lock button 54 includes a main portion 132 sized substantially similar to the lock button recess 100, a T-shaped protrusion 136 extending downwardly from the rear of the main portion 132, a retainer clip 140 extending downwardly from the front of the main portion 132, and a lock spring retainer 144 (FIG. 5) extending downwardly from the center of the main portion 132. The lock spring 50 includes a retainer aperture 145 (FIGS. 2 and 5) sized similar to the lock spring retainer 144.

For assembly, the retainer aperture 145 of the lock spring 50 is placed around the lock spring retainer 144 and the lock button 54 is placed into the lock button recess 100. When the lock button 54 is placed in the lock button recess 100, the lock spring 50 biases the lock button 54 to an upper position (FIG. 5), the T-shaped protrusion 136 extends through the T-shaped protrusion aperture 104 and into the lock button slot 124, and the retainer clip 140 extends through the retainer clip aperture 108 to secure the lock button 54 to the comb button 46.

When the lock spring 50 biases the lock button 54 to the upper position, the T-shaped protrusion 136 rests between the inwardly facing protrusions 128 in one of the cutting notches 129, thus holding the comb 38 in one of the predetermined positions. When the operator depresses or actuates the lock button 54, the T-shaped protrusion 136 moves out of the cutting notch 129 and passes under the inwardly facing protrusions 128 allowing the cutting position of the comb 38 to be adjusted by slidably moving the comb button 46 along the outer surface of the top portion 14*a*. The cutting position of the comb 38 can be adjusted either in the direction of increasing cutting length or in the direction of decreasing cutting length using this method. The indexing movement provided by the cooperation of the set of upwardly facing protrusions 88 and the index arms 66 provides for ease of selection even when the lock button 54 is fully depressed and the T-shaped protrusion 136 is out of engagement with the inwardly facing protrusions 128 (i.e., not in one of the cutting notches 129). In this way, the operator can feel and hear the actuator assembly move the comb 38 through the predetermined positions.

The T-shaped protrusion 136 also includes ramped portions 154 (FIG. 5), which allow the T-shaped protrusion 136 to ramp over the inwardly facing protrusions 128 in the direction of the fully extended position. In contrast, the cutting length can be adjusted in the direction of the fully retracted position only by depressing the lock button 54. This prevents an inadvertent increase in the amount of hair being cut caused by a force applied during operation of the hair trimmer 10.

The actuator assembly allows an operator of the hair trimmer 10 to move the comb 38 to a number of predetermined positions between a fully retracted and a fully extended position for varying the cutting length of the hair trimmer.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

What is claimed is:

1. A hair trimmer having an adjustable comb, the hair trimmer comprising:

a body having a cutting end, an inner cavity, and a pair of slots extending from the cutting end, each slot including an aperture portion in communication with the inner cavity;

a cutting head having a blade set, the cutting head being connected to the cutting end, the comb being movable in the slots relative to the blade set;

an electric motor at least partially disposed in the inner cavity, the electric motor being drivingly connected to the blade set to effect a cutting action; and an actuator assembly capable of moving the comb in the slots relative to the blade set between a fully retracted position and a fully extended position, the hair trimmer cutting a maximum amount of hair when the comb is in the fully retracted position and a minimum amount of hair when the comb is in the fully extended position, the actuator assembly including a comb carriage disposed at least partially in the inner cavity, the comb carriage including a pair of comb arms, each comb arm extending through a respective one of the aperture portions to engage the comb for movement of the comb with the comb carriage, a comb button connected to the comb carriage and movable relative the body, the comb button being actuatable to adjust the position of the comb relative to the blade set, and a lock button movable relative to the comb button, the lock button selectively preventing and permitting movement of the comb button relative to the body, the comb button being movable to facilitate movement of the comb toward the fully retracted position when the lock button is actuated to permit movement of the comb button.

2. A hair trimmer according to claim 1 wherein the actuator assembly further includes a spring member positioned between the comb button and the lock button, the spring member biasing the lock button to a first position, and wherein the comb button is not movable to facilitate movement of the comb toward the fully retracted position when the lock button is in the first position.

3. A hair trimmer according to claim 2 wherein the comb button is movable to facilitate movement of the comb toward the fully extended position when the lock button is in the first position.

4. A hair trimmer according to claim 2 wherein the comb button is movable to facilitate movement of the comb toward the fully retracted position and toward the fully extended position when the lock button is actuated to a second position.

5. A hair trimmer according to claim 1 wherein the comb includes a pair of guides, each guide including a notch and being movable in a respective one of the slots for movement of the comb relative to the blade set, wherein each comb arm includes a protrusion, and wherein each protrusion engages a respective one of the notches for movement of the comb with the comb carriage.

6. A hair trimmer according to claim 5 wherein each guide includes ramped end portions, the ramped end portions facilitating movement of the comb in the slots for connection to and disconnection from the comb carriage.

7. A hair trimmer according to claim 1 wherein a portion of each comb arm extending through the respective one of the aperture portions to engage the comb is deflected inwardly toward the inner cavity when the comb is connected to and disconnected from the comb carriage.

8. A hair trimmer according to claim 7 wherein the comb is connected to and disconnected from the comb carriage in the fully retracted position.

9. A hair trimmer according to claim 1 wherein the comb is movable to a number of predetermined positions between the fully retracted position and the fully extended position for varying the cutting length of the hair trimmer.

10. A hair trimmer according to claim 9 wherein the body includes a lock button aperture defining a number of cutting notches, wherein the lock button includes a lock button protrusion that extends into the lock button aperture for movement between the cutting notches, and wherein the comb is positioned at one of the predetermined positions when the lock button protrusion is positioned in a corresponding cutting notch.

11. A hair trimmer according to claim 10 wherein the lock button protrusion includes at least one ramped portion that facilitates movement of the lock button protrusion between the cutting notches when moving the comb toward the fully extended position.

12. A hair trimmer according to claim 10 wherein the lock button is actuated to disengage the lock button protrusion from one of the cutting notches to facilitate movement of the lock button protrusion between the cutting notches when moving the comb toward the fully retracted position.

13. A hair trimmer according to claim 10 wherein the actuator assembly further includes a spring member positioned between the comb button and the lock button, wherein the spring member biases the lock button to a first position, and wherein the lock button protrusion engages one of the cutting notches when the lock button is in the first position.

14. A hair trimmer according to claim 1 wherein the body includes a plurality of index protrusions extending into the inner cavity, and wherein the comb carriage includes at least one index arm that cooperates with the index protrusions to provide an indexing action to the movement of the comb between the fully retracted position and the fully extended position.

15. A hair trimmer according to claim 1 wherein the body includes at least one comb button slot in communication with the inner cavity, wherein the comb button is connected to the comb carriage through the comb button slot, and wherein the comb button is movable in the comb button slot relative to the body.

16. A hair trimmer having an adjustable comb, the hair trimmer comprising:

a body including a cutting end, an inner cavity, a pair of comb slots extending from the cutting end, each comb slot including a comb arm aperture in communication with the inner cavity, and a plurality of index protrusions extending into the inner cavity;

a cutting head having a blade set, the cutting head being connected to the cutting end, the comb including a pair of guides, each guide including a notch and being movable in a respective one of the comb slots for movement of the comb relative to the blade set;

an electric motor at least partially disposed in the inner cavity, the electric motor being drivingly connected to the blade set to effect a cutting action; and an actuator assembly capable of moving the comb in the slots relative to the blade set between a fully retracted position and a fully extended position, the hair trimmer cutting a maximum amount of hair when the comb is in the fully retracted position and a minimum amount of hair when the comb is in the fully extended position, the actuator assembly including a comb carriage disposed at least partially in the inner cavity, the comb carriage including a pair of comb arms and at least one index arm, each comb arm extending through a respective one of the comb arm apertures to engage a respective one of the notches for movement of the comb with the comb carriage, the at least one index arm cooperating with the index protrusions to provide an indexing action to the movement of the comb between the fully retracted position and the fully extended position, a comb button connected to the comb carriage and movable relative to the body, the comb button being actuatable to adjust the position of the comb relative to the blade set, and a lock button movable relative to the comb button, the lock button selectively preventing and permitting movement of the comb button relative to the body, the comb button being movable to facilitate movement of the comb toward the fully retracted position and the fully extended position when the lock button is actuated to permit movement of the comb button, the comb button being movable to facilitate movement of the comb toward the fully extended position when the lock button is positioned to prevent movement of the comb toward the fully retracted position.

17. A hair trimmer having an adjustable comb, the hair trimmer comprising:

a body including a cutting end, an inner cavity, a pair of comb slots extending from the cutting end, each comb slot including a comb arm aperture in communication with the inner cavity, a lock button aperture, the lock button aperture defining a plurality of cutting notches, at least one comb button slot, the comb button slot being in communication with the inner cavity, and a plurality of index protrusions extending into the inner cavity;

a cutting head having a blade set, the cutting head being connected to the cutting end, the comb including a pair of guides, each guide including a notch and being movable in a respective one of the comb slots for movement of the comb relative to the blade set;

an electric motor at least partially disposed in the inner cavity, the electric motor being drivingly connected to the blade set to effect a cutting action; and an actuator assembly capable of moving the comb in the slots relative to the blade set between a fully retracted position and a fully extended position, the hair trimmer cutting a maximum amount of hair when the comb is in the fully retracted position and a minimum amount of hair when the comb is in the fully extended position, the actuator assembly including a comb carriage disposed at least partially in the inner cavity, the comb carriage including a pair of comb arms and at least one index arm, each comb arm extending through a respective one of the comb arm apertures to engage a respective one of the notches for movement of the comb with the comb carriage, the at least one index arm cooperating with the index protrusions to provide an indexing action to the movement of the comb between the fully retracted position and the fully extended position, a comb button connected to the comb carriage through the comb button slot and movable in the comb button slot relative to an outer surface of the body, the comb button being actuatable to adjust the position of the comb relative to the blade set, a lock button movable relative to the comb button and including a lock button protrusion, the lock button selectively preventing and permitting movement of the comb button relative to the outer surface of the body, and a spring member positioned between the comb button and the lock button, the spring member biasing the lock button to a first position where the lock button protrusion engages one of the cutting notches so the comb button is prevented from moving to facilitate movement of the comb toward the fully retracted position.

* * * * *